US007878846B2

(12) United States Patent
Zhu

(10) Patent No.: US 7,878,846 B2
(45) Date of Patent: Feb. 1, 2011

(54) STACKED ELECTRICAL CONNECTORS ON OPPOSITE SIDES OF A PRINTED CIRCUIT BOARD

(75) Inventor: Jian-Kuang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 119 days.

(21) Appl. No.: 12/317,418

(22) Filed: Dec. 22, 2008

(65) Prior Publication Data

US 2009/0163055 A1 Jun. 25, 2009

(51) Int. Cl.
*H01R 13/60* (2006.01)

(52) U.S. Cl. ..... 439/541.5; 439/325

(58) Field of Classification Search ..... 439/83, 439/61, 260, 325, 326, 328, 540.1, 541.5; 361/736, 748

See application file for complete search history.

(56) References Cited

U.S. PATENT DOCUMENTS 4,303,291 A * 12/1981 Dines ..... 29/843
5,080,611 A * 1/1992 Hypes ..... 439/567
5,641,295 A 6/1997 Koyama
5,707,242 A * 1/1998 Mitra et al. ..... 439/74
6,416,333 B1 * 7/2002 Hasegawa et al. ..... 439/74
7,794,259 B2 * 9/2010 Zhu et al. ..... 439/327

* cited by examiner

*Primary Examiner*—Edwin A. Leon
*Assistant Examiner*—Vanessa Girardi
(74) *Attorney, Agent, or Firm*—Andrew C. Cheng; Wei Te Chung; Ming Chieh Chang

(57) ABSTRACT

For reasonably using the space of a printed circuit board (PCB) an electrical connector assembly which is mounted on the PCB is provided and includes an upper an upper connector and a lower connector stacked together. The upper connector includes a plurality of first contacts each having a first horizontal soldering leg are soldered on a top surface of the PCB. The lower connector includes a plurality of second contacts each having a second vertical soldering leg soldered on a bottom surface of the PCB. The bottom surface of the PCB has a plurality of soldering holes which are not running through the top surface thereof for retaining said second vertical soldering legs therein so as to provide an available soldering area for said first horizontal soldering legs on the top surface thereof.

19 Claims, 4 Drawing Sheets

STACKED ELECTRICAL CONNECTORS ON OPPOSITE SIDES OF A PRINTED CIRCUIT BOARD

BACKGROUND OF THE INVENTION

1. Field of the Invention

The present invention relates to an electrical connector assembly, and more particularly to an electrical connector assembly for connecting a memory module to a PCB (printed circuit board) electrically.

2. Description of Related Art

As disclosed in U.S. Pat. No. 5,641,295, an electrical connector for connecting with two memory modules comprises a longitudinal insulating housing and a plurality of contacts retained in said insulating housing. Said insulating housing defines two longitudinal insertion slots, an upper insertion slot and a lower insertion slot which are stacked vertically for receiving two memory modules electrically. The contacts are divided into an upper group with two rows and a lower group with two rows. Each contact has a contacting beam exposing in said corresponding insertion slot and a soldering leg outside of the insulating housing and to be soldered on a surface of PCB. The soldering legs of the upper group contacts are arranged at an outer line, while the soldering legs of the lower group contacts are soldered at an inner line with relative to the insulating housing. Both the soldering legs of the upper group contacts and lower group contacts are soldered on the same surface of the PCB. Correspondingly, the PCB should provide an inner area for the soldering legs of lower group contacts and an outer area for the soldering legs of upper group contacts on the surface thereof, which will enhance the size of the electrical connector and occupy a large area of the PCB, especially in a high-density connector with mass contacts.

So it is necessary to provide a new electrical connector assembly to solve the problems above.

SUMMARY OF THE INVENTION

Accordingly, it is an object of the present invention to provide an electrical connector assembly which can reduce size and the occupancy on a PCB.

In order to achieve above-mentioned object, an electrical connector assembly mounted on a PCB comprises an upper connector downwardly mounted on a first surface of said PCB and a lower connector stacked under said upper connector and upwardly mounted on a second surface of said PCB. Said upper connector includes a plurality of first contacts, each first contact has a first soldering leg soldered on said first surface of said PCB. Said lower connector includes a plurality of second contacts, each second contact has a second soldering leg soldered on said second surface of said PCB. Said second soldering legs are upwardly soldered and vertically stacked below said first soldering legs in one to one on said second surface of the PCB.

Other objects, advantages and novel features of the present invention will become more apparent from the following detailed description of the present embodiment when taken in conjunction with the accompanying drawings.

DETAILED DESCRIPTION OF THE INVENTION

Figure 1:
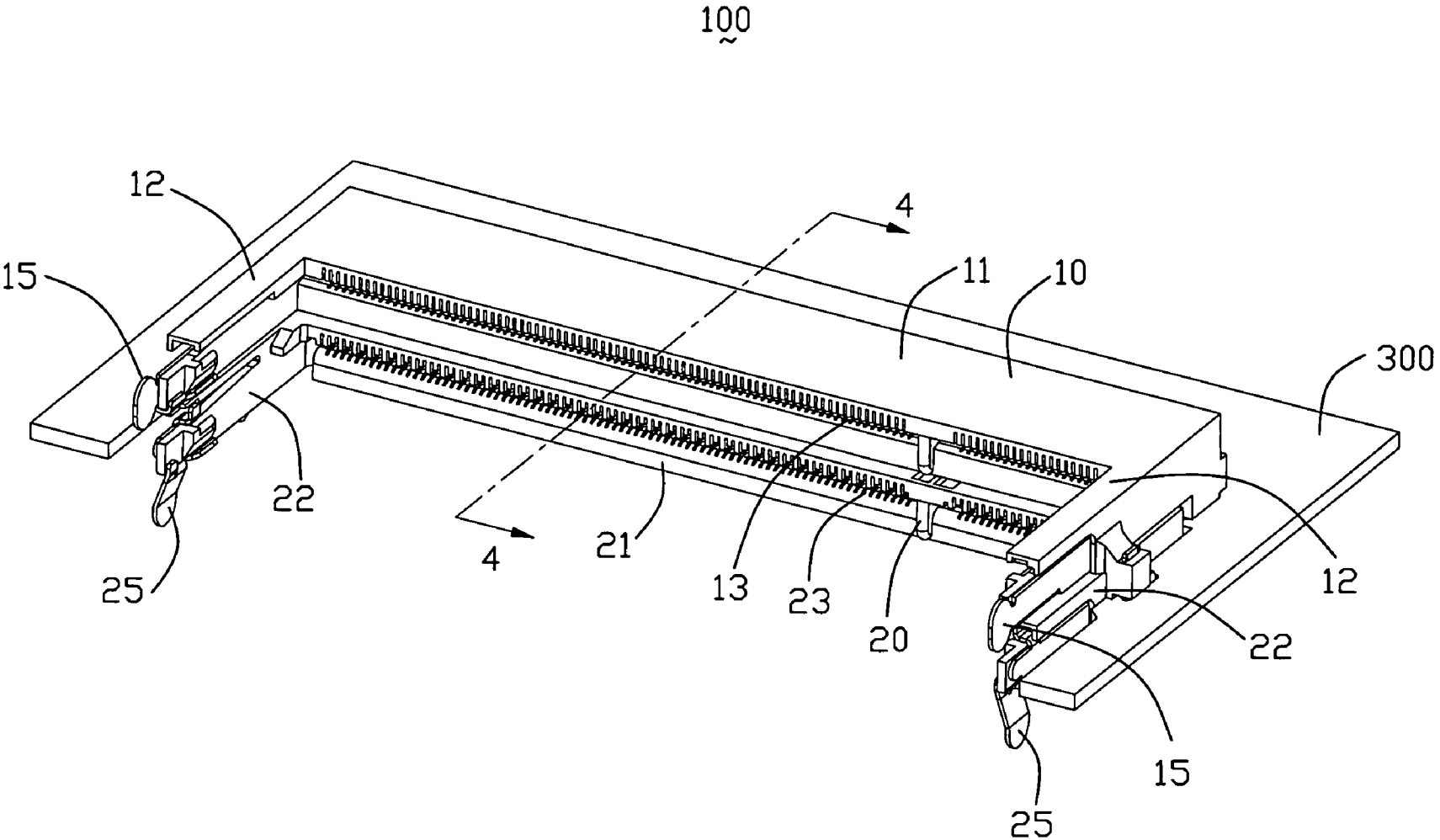
FIG. 1 is a perspective view of the electrical connector assembly in accordance with the present invention.

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Referring to FIG. 1 to FIG. 4, an electrical connector assembly 100 for electrically connecting two memory modules 200 to a printed circuit board (PCB) 300, comprises a lower connector 20 mounted on the PCB 300 and an upper connector 10 stacked above said lower connector 20. Said PCB 300 has a top surface 301 and a bottom surface 302 and a notch 310 extending through an outer region thereof. The upper connector 10 and lower connector 20 are respectively located at the top surface 301 and bottom surface 302 thereof.

Figure 2:
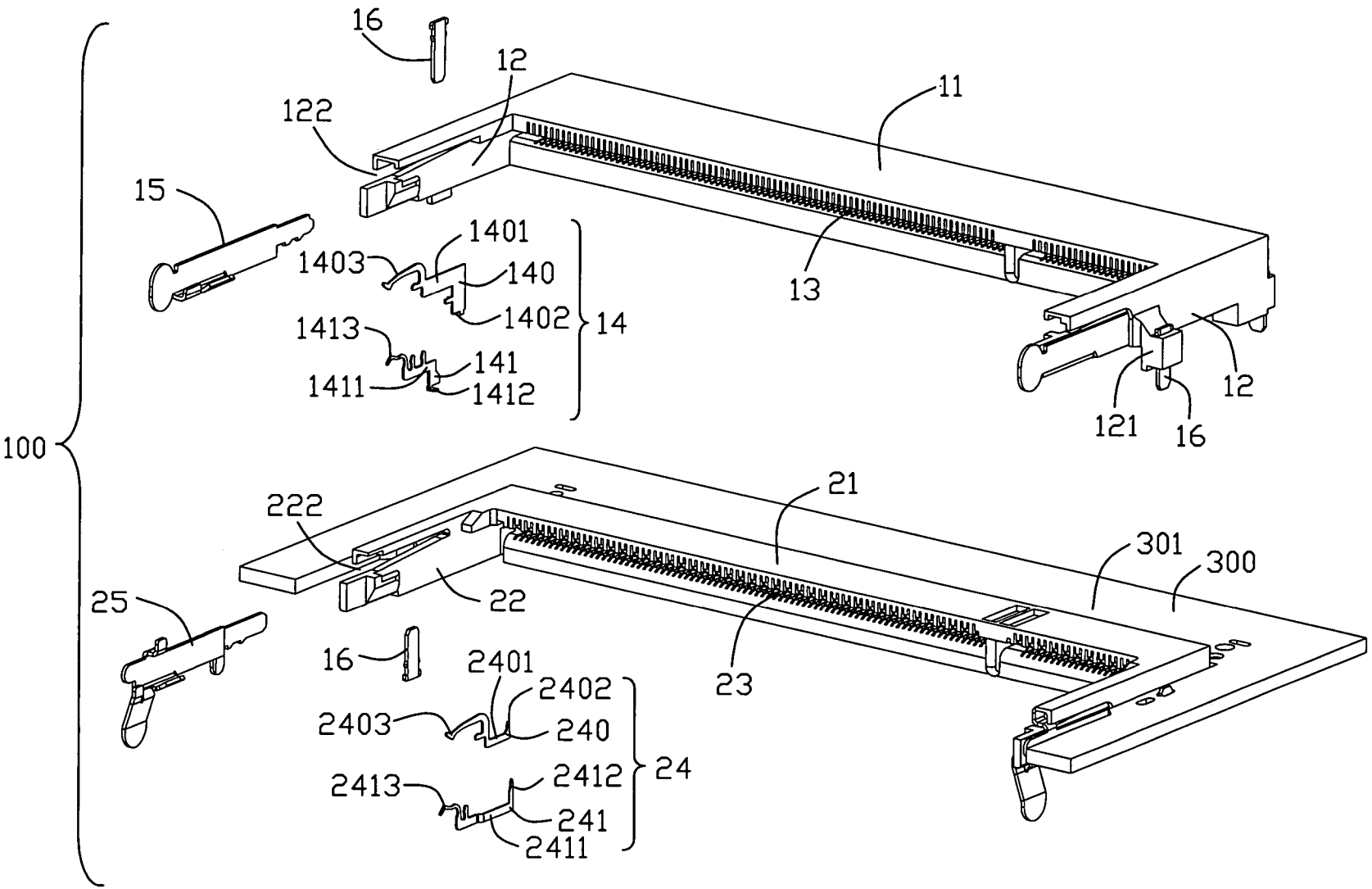
FIG. 2 is a partially exploded perspective view of the electrical connector assembly of FIG. 1.

Referring to FIG. 1 and FIG. 2, the upper connector 10 comprises an upside-down L-shaped insulating housing 11 with a horizontal portion 101 on the top surface 301 of the PCB 300 and a vertical portion 102 standing above the notch 310, a plurality of first contacts 14 retained in said insulating housing and a pair of first release members 15. A pair of first locking arms 12 extend horizontally and perpendicularly from two longitudinal ends of said insulative housing 11, thereby a first receiving space is defined thereamong for receiving said memory module 200. Said insulative housing 11 has a longitudinal first slot 13 opening to said receiving space. Said first slot 13 defines a plurality of passageways (no labeled) at opposite inner sides thereof for receiving the first contacts 14. Each first locking arm 12 has a projection 121 extending outwardly from an outer sidewall and a first locking groove 122 for retaining said first release member 15. Said projection 121 engages with a metal fastener 16 so as to mount the first locking arms 12 on the top surface 301 of the PCB 300 tightly.

Figure 3:
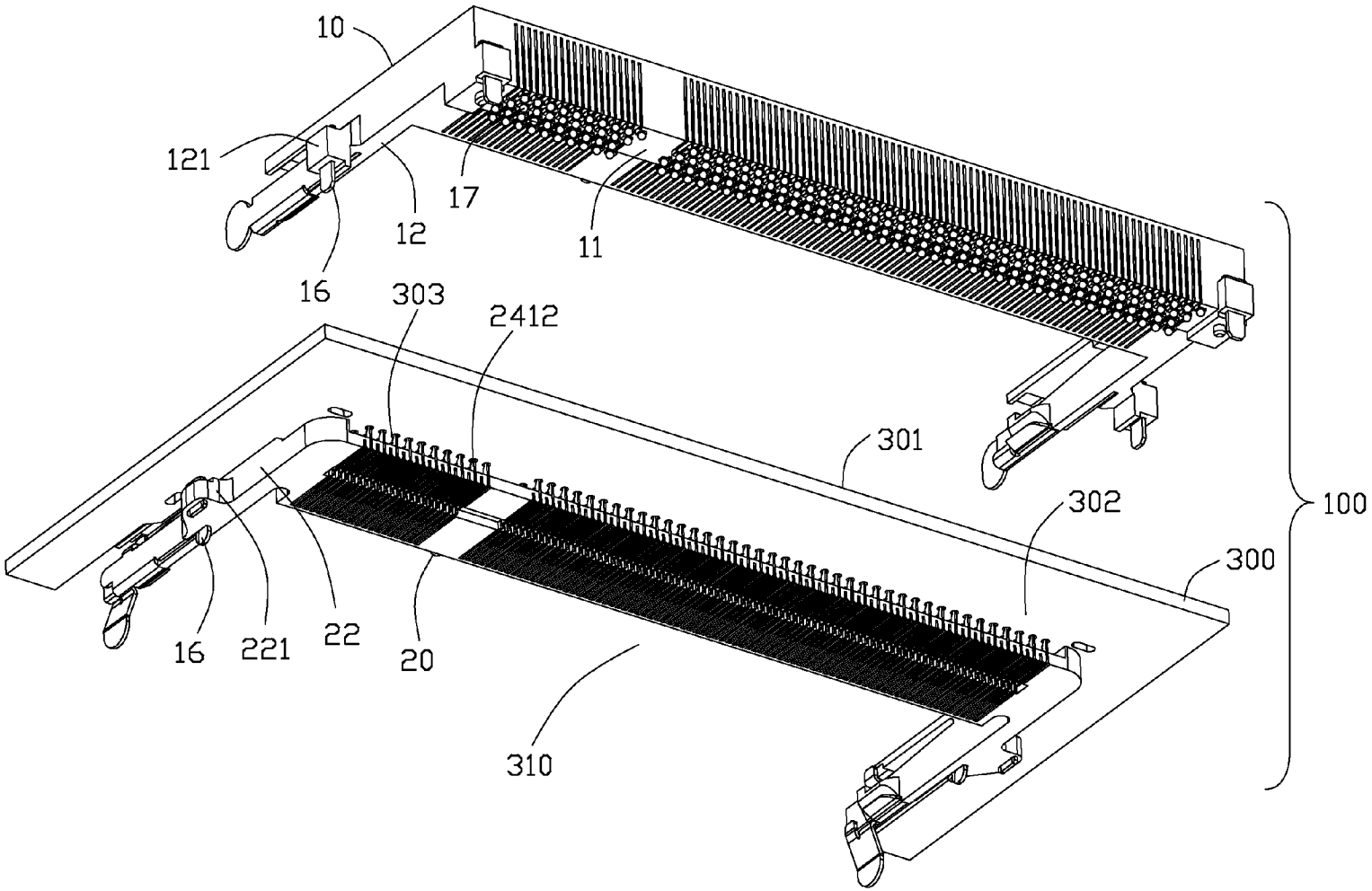
FIG. 3 is a perspective view of the electrical connector assembly from another view.

Said first contacts 14 are divided into two rows, a first upper row contacts 140 and a first lower row contacts 141 with high-density. Each contact 140/141 comprises a vertical L-shaped base portion 1401/1411, a contacting portion 1403/1413 extending into said first slot 13 for contacting with said memory module 200, and a horizontal first soldering leg 1402/1412 extending horizontally from a bottom of said base portion 1401/1411. Said first soldering leg 1402/1412 is located on a lateral side of said base portion 1401/1411 with high-density longitudinally and the soldering leg 1402 of the first upper row contact 140 is staggered with that of the first lower row contact 141. The bottom mounting face of the soldering legs 1402/1412 are adapted for adhibiting soldering balls as shown in FIG. 3 and defined on the first soldering legs 1402/1412 in order to mount on said top surface 301 of the PCB 300. The first release member 15 engages with said first locking groove 122 horizontally for releasing the memory module 200 off.

As referring to FIG. 2 and FIG. 3, the lower connector 20 which is familiar with said upper connector 10 comprises an upstanding L-shaped lower insulating housing 21 with a horizontal section 201 on the bottom surface 302 of the PCB 300 and a vertical section 202 disposed in the notch 310, a plurality of second contacts 24 retained in said lower insulating housing, and a pair of second release members 25. Said lower insulating housing 21 defines a longitudinal second slot 23, and a pair of second locking arms 22 extending horizontally and perpendicularly from two longitudinal ends thereof thereby a second receiving space is defined therebetween for receiving said memory module 200. Said second release member 25 engages with a second locking groove 222 of the second locking arm 22 horizontally, while a metal fastener 16 engages with a projection 221 of second locking arm 22 upwardly for mounting on the bottom surface 302 of the PCB 300. Said lower connector 20 is vertically located below the PCB 300 and upwardly mounted on the bottom surface 302 of the PCB 300, which will decrease the height of the connector assembly 100 and saves the soldering area of the top surface 301 of the PCB 300. Additionally, the vertical portion 102 of the upper connector 10 is located in essentially vertical alignment with the vertical section 202 of the lower connector 20.

Said second contacts 24 of the lower connector 20 are divided into two rows, a second upper row and a second lower row respectively comprising a plurality of second upper row contacts 240 and second lower row contacts 241 for electrically connecting with said memory module 200. Said contact 240/241 has a horizontal base portion 2401/2411, a spring contacting portion 2403/2413 contacting with said memory module 200 and a vertical second soldering leg 2402/2412 extending vertically from one end of said horizontal base portion 2401, 2411. Said vertical second soldering legs 2402/2412 are pin type and mounted on the bottom surface 302 of the PCB 300 upwardly.

Figure 4:
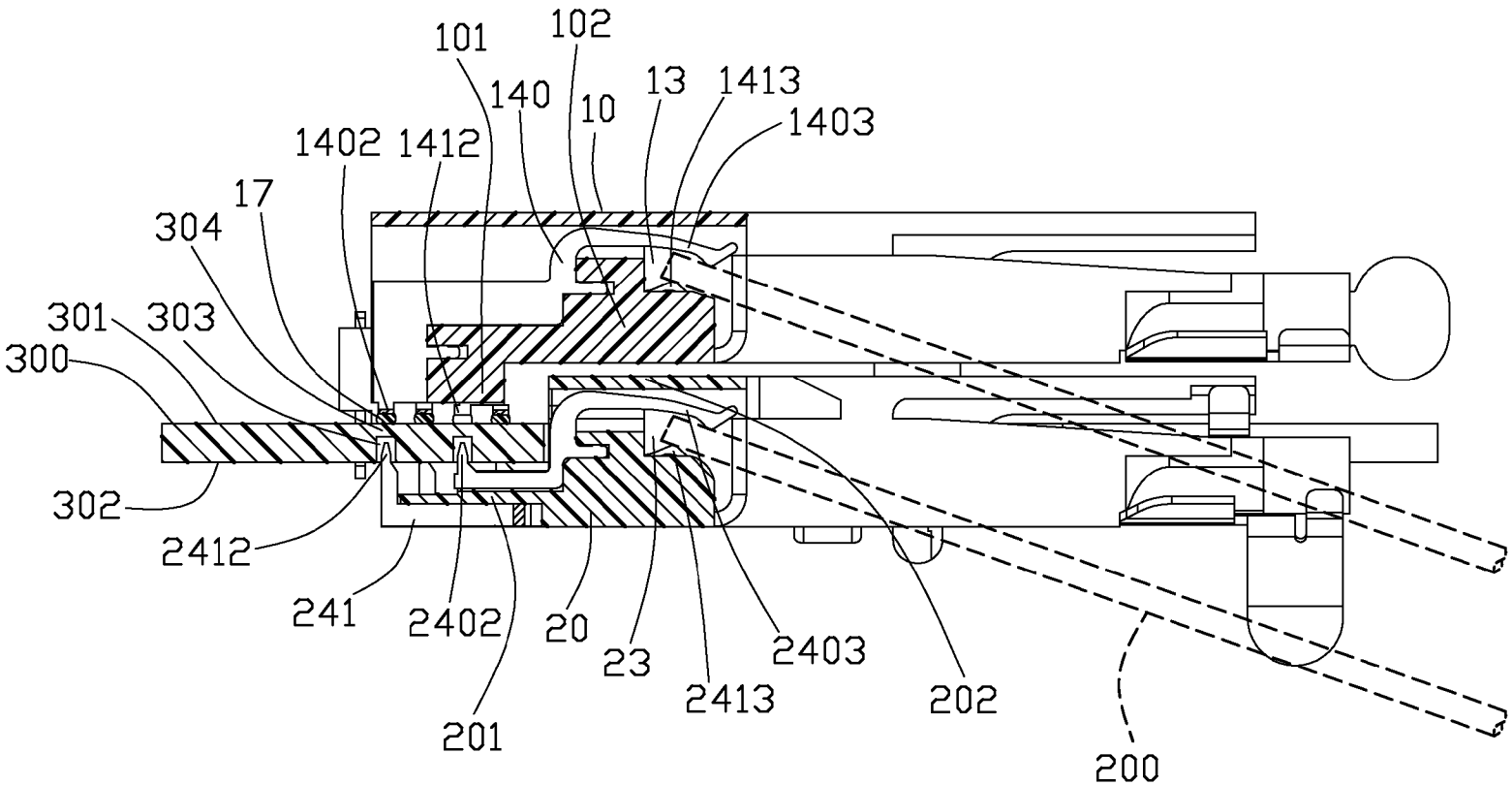
FIG. 4 is a cross-section view of the electrical connector assembly in FIG. 1 along the line 4-4.

As shown in FIG. 4, said bottom surface 302 of the PCB 300 has a plurality of soldering holes 303 which are corresponding to said second contacts 24 one to one for receiving said second soldering legs 2402/2412 therein. Said second soldering legs 2402/2412 are correspondingly located under said first soldering legs 1402/1412 in an one-to-one relationship by orderliness, and said soldering holes 303 are formed into the PCB 300 without running through the top surface 301 upwardly in order to provide an available soldering surface for soldering of the first soldering legs 1402/1412. That is to say, the first soldering legs 1402/1412 and the second soldering legs 2402/2412 share a same inner region of the PCB 300. Said lower connector 20 are upwardly mounted on the bottom surface 302 of the PCB 300 under said upper connector 10 while the second soldering legs 2402/2412 are inserted into said soldering holes 303. As referring to FIG. 1, after assembly, said upper connector 10 and said lower connector 20 are vertically stacked on the top surface 301 and bottom surface 302 of the PCB 300 respectively. Moreover, the first soldering legs 1402/1412 can be soldered on a reversed area of said soldering holes 303 on the top surface 301, which decreases the size of the electrical connector assembly 100 and saves the space of the PCB 300 efficiently.

As referring to FIG. 4, said memory modules 200 are inserted into the first slot 13 and second slot 23 at an angle to electrically contact with said first contacts 14 and second contacts 24. Said upper row contacts 140/240 of the contacts 14/24 are extending much closer to an opening of said slots 13/23 than the lower row contacts 141/241 in order to contact with said memory modules 200 slantwise.

Alternatively, as we known, said soldering holes 303 also can be formed on the top surface 301 if the thickness of the PCB is large enough in present embodiment. Meanwhile, said first soldering legs 1402/1412 can be formed as vertical type for soldering into the soldering holes on the top surface 301, which also saves the space of the PCB 300 efficiently.

However, while the preferred embodiment of the invention have been shown and described, it will apparent to those skilled in the art that changes and modifications may be made therein without departing from the spirit of the invention, the scope of which is defined by the appended claims.

What is claimed is:

1. An electrical connector assembly mounted on a printed circuit board (PCB), comprising:

an upper connector downwardly mounted on a first surface of said PCB, including a plurality of first contacts, each first contact having a first soldering leg soldered on said first surface of said PCB;

a lower connector stacked under said upper connector and upwardly mounted on a second surface of said PCB, including a plurality of second contacts, each second contact having a second soldering leg soldered on said second surface of said PCB; wherein said second soldering legs are upwardly soldered on the second surface of the PCB and vertically stacked below said first soldering legs in an one-to-one relationship with the first soldering legs;

wherein said second soldering legs are pin type and imbedded into said PCB upwardly from the second surface without going through the first surface of the PCB.

2. The electrical connector assembly as claimed in claim 1, wherein the upper connector and the lower connector respectively define a longitudinal slot opened toward a same direction for receiving a memory module therein at an angle.

3. The electrical connector assembly as claimed in claim 1, wherein said first soldering legs are soldered on the first surface of the PCB above said second soldering legs.

4. The electrical connector assembly as claimed in claim 3, wherein said lower connector is located under said upper connector and extends downwardly beyond said PCB.

5. The electrical connector assembly as claimed in claim 4, wherein a part of said lower connector is located above said first surface of the PCB.

6. The electrical connector assembly as claimed in claim 5, wherein both said upper connector and lower connector has a longitudinal slot for receiving a memory module upwardly and at an angle.

7. The electrical connector assembly as claimed in claim 6, wherein each of said first contact and second contact includes an upper row contact and a lower row contact, said upper and lower row contact of the first contact are assembled forwardly while that of the second contact are assembled upwardly.

8. The electrical connector assembly as claimed in claim 7, wherein each of said upper row contact and lower row contact of said first contact has a horizontal soldering leg soldered on the first surface of the PCB.

9. The electrical connector assembly as claimed in claim 7, wherein each of said upper row contact and lower row contact of said second contact has a vertical second soldering leg which is upwardly inserted into a soldering hole formed on the second surface of the PCB.

10. The electrical connector assembly as claimed in claim 9, wherein said soldering holes are formed corresponding to said second soldering legs in an one-to-one relationship without going through the first surface of the PCB upwardly.

11. An electrical connector assembly comprising:

a printed circuit board defining opposite first and second surfaces with a notch extending through an outer region thereof;

a first connector having an upstanding L-shaped housing with a horizontal section on the first surface and a vertical section disposed above the notch;

a plurality of first contacts disposed in the upstanding L-shaped housing;

a second connector having an upside-down L-shaped housing with a horizontal portion on the second surface and a vertical portion located in essentially vertical alignment with the vertical section and located in the notch and extends beyond both the first surface and the second surface; and a plurality of second contacts disposed in the upside-down L-shaped housing; wherein soldering tails of the first contacts are mounted to the first surface and soldering tails of the second contacts are mounted to the second surface while sharing a same inner region of the printed circuit board.

12. The electrical connector assembly as claimed in claim 11, wherein soldering tails of the first and second contacts are different, and the soldering tails of the second contacts are pin type and partly embedded in the printed circuit board.

13. The electrical connector assembly as claimed in claim 11, wherein a distance defined between corresponding first and second solder tails is smaller than a thickness of the printed circuit board.

14. The electrical connector assembly as claimed in claim 11, wherein the first connector includes a first metal fastener extendding from the first surface through the printed circuit board beyond the second surface, and the second connector includes a second metal fastener extending from the second surface through the printed circuit board beyond the first surface.

15. The electrical connector assembly as claimed in claim 11, wherein said first surface is higher than the second surface.

16. The electrical connector assembly as claimed in 15, wherein the second connector defines a longitudinal slot to receive a memory module which is only allowed to be assembled thereto in an angled direction with upward rotation from the second surface to the first surface until said memory module is parallel to the printed circuit board.

17. The electrical connector assembly as claimed in claim 16, wherein said first connector defines another longitudinal slot receive another memory module which is also only allowed to be assembled thereto in a similar angled direction with the same rotation above said memory module under condition that said another memory module passes the notch during assembling.

18. The electrical connector assembly as claimed in claim 17, wherein each of said first and second connectors are equipped with a pair of resilient latches for holding the corresponding memory module, and the pair of latches of the second connector are located in the notch.

19. The electrical connector assembly as claimed in claim 18, wherein each of said pair of latches includes an operation handle, and the handles of the pair of latches of the second connector extend downwardly while the handles of the pair of latches of the first connector extend horizontally.

* * * * *